US006395642B1

(12) United States Patent
Liu et al.

(10) Patent No.: US 6,395,642 B1
(45) Date of Patent: May 28, 2002

(54) METHOD TO IMPROVE COPPER PROCESS INTEGRATION

(75) Inventors: Chung-Shi Liu; Chen-Hua Yu, both of Hsin-Chu (TW)

(73) Assignee: Taiwan Semiconductor Manufacturing Company, Hsin-Chu (TW)

( * ) Notice: Subject to any disclaimer, the term of this patent is extended or adjusted under 35 U.S.C. 154(b) by 0 days.

(21) Appl. No.: 09/473,032

(22) Filed: Dec. 28, 1999

(51) Int. Cl.[7] ..... H01L 21/302
(52) U.S. Cl. ..... 438/720; 438/722; 134/95
(58) Field of Search ..... 438/703, 710, 438/712, 720, 722, 687; 134/95

(56) References Cited

U.S. PATENT DOCUMENTS 5,151,168 A 9/1992 Gilton et al. ..... 205/123
5,424,246 A * 6/1995 Matsuo et al. ..... 437/192
5,662,788 A 9/1997 Sandhu et al. ..... 205/87
5,723,387 A 3/1998 Chen ..... 438/692
5,821,168 A 10/1998 Jain ..... 438/692
5,882,498 A 3/1999 Dubin et al. ..... 205/261
5,897,375 A * 4/1999 Watts et al. ..... 438/693
6,033,584 A * 3/2000 Ngo et al. ..... 216/67

* cited by examiner

*Primary Examiner*—Benjamin L. Utech
*Assistant Examiner*—Kin-Chan Chen
(74) *Attorney, Agent, or Firm*—George O. Saile; Stephen B. Ackerman; Sevgin Oktay

(57) ABSTRACT

A method is disclosed to improve copper process integration in the forming copper interconnects in integrated circuits. This is accomplished by integrating the process of forming a copper seed layer in an interconnect structure such as a trench or a groove, with the process of plasma cleaning of the structure prior to the electroplating of copper into the trench. $NH_3$ plasma can be used for this purpose. Or, $H_2/N_2$ thermal reduction can also be employed. The integrated process promotes well-controlled electro-chemical deposition (ECD) of copper for solid filling of the trench.

17 Claims, 2 Drawing Sheets

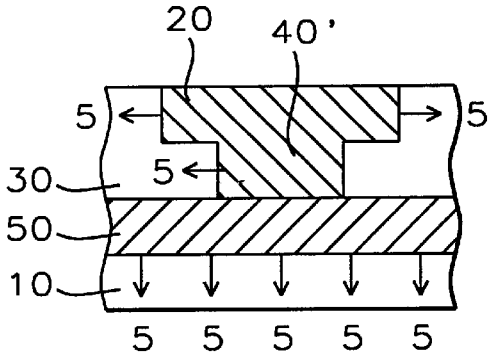
FIG. 1a – Prior Art
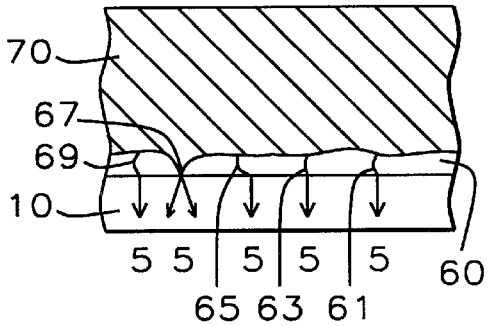
FIG. 1b – Prior Art
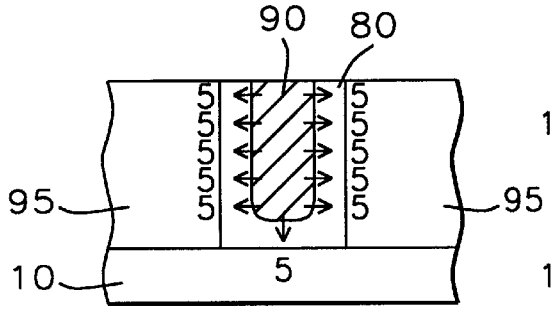
FIG. 1c – Prior Art
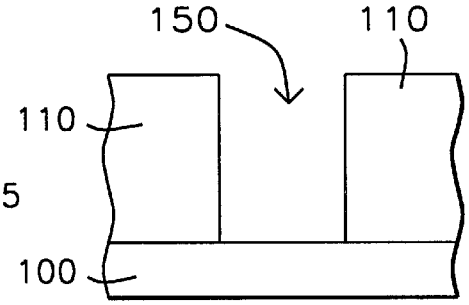
FIG. 2a
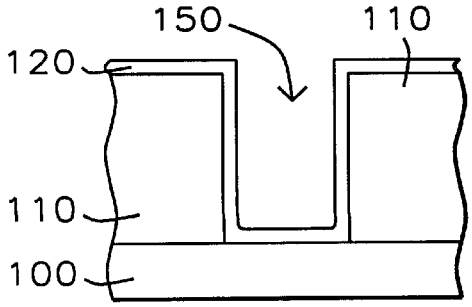
FIG. 2b
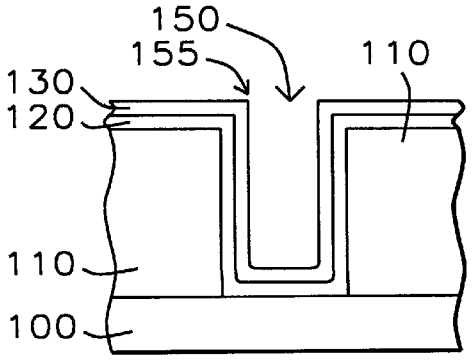
FIG. 2c

METHOD TO IMPROVE COPPER PROCESS INTEGRATION

BACKGROUND OF THE INVENTION (1) Field of the Invention

The present invention relates to the manufacture of integrated circuits in general, and in particular, to a copper process integration in the forming of copper interconnections with improved adhesion and resistance to electromigration.

(2) Description of the Related Art

In the manufacture of semiconductors, the use of copper (Cu) in interconnection metallurgy systems has long been considered as an alternative metallization material to aluminum (Al) and Al alloys due to its low resistivity and ability to reliably carry high current densities. However, its use has presented many problems, such as the possibility of diffusion into the semiconductor substrate, the low adhesive strength of Cu to various insulating layers and the difficulties inherent in masking and etching the blanket Cu layer into intricate circuit structures. In particular, the low adhesive strength of Cu to dielectrics can cause serious reliability problems in integrated circuits. In its simplest form, for example, a trench or groove of desired shape, depth and length can be formed in an insulator, and then filled with copper, as will be described in more detail below. Unless the inside walls of the trench are treated properly, Cu will not adhere with the attendant problems of peeling, delamination, and so on. Furthermore, copper will diffuse into the surrounding dielectric causing other reliability problems. To prevent these problems, it is common first to deposit a lining inside the trench prior to depositing copper. It is disclosed later in the embodiments of the present invention a method of forming a barrier lining as well as a Cu seed layer to improve the strength of copper adhesion, limit the diffusion of copper into surrounding materials and alleviate electromigration as known in the art.

Aluminum alloys are the most commonly used conductive materials. However, with the advent of very and ultra large scale integrated (VLSI and ULSI) circuits, the device dimensions have been continually shrinking. Thus, it has become more and more important that the metal conductors that form the interconnections between devices as well as between circuits in a semiconductor have low resistivities for faster signal propagation. Copper is often preferred for its low resistivity- about 40% less than that of aluminum- as well as for resistance to electromigration and stress voiding properties. Unfortunately, however, copper suffers from high diffusivity in common insulating materials such as silicon oxide, and oxygen-containing polymers. This can cause corrosion of the copper with the attendant serious problems of loss of adhesion, delamination, voids, electromigration, and ultimately a catastrophic failure of the circuitry.

Conventionally, the various metal interconnect layers in a semiconductor substrate are formed separately, and serially. First, a first blanket metal is deposited on a first insulating layer and electrical lines are formed by subtractive etching of the metal through a first mask. A second insulating layer is formed over the first metallized layer, and the second insulating layer is patterned with holes using a second mask. The holes are then filled with metal, thus forming metal columns, or plugs, contacting the first metal layer. A second blanket metal layer is formed over the second insulating layer containing the columnar plugs which now connect the upper second metal layer with the lower first metal layer. The second metal layer is next patterned with another mask to form a set of new electrical lines, and the process is repeated as many times as it is needed to fabricate a semiconductor substrate. It will be observed that patterning, that is, photolithography and etching of metal layers to form the needed interconnects constitute a significant portion of the process steps of manufacturing semiconductor substrates, and it is known that both photolithography and etching are complicated processes. It is desirable, therefore, to minimize such process steps, and a process known as dual damascene, provides such an approach. The term 'damascene' is derived from a form of inlaid metal jewelry first seen in the city of Damascus. In the context of integrated circuits it implies a patterned layer imbedded on and in another layer such that the top surfaces of the two layers are coplanar.

In a single damascene process, grooves are formed in an insulating layer and filled with metal to form conductive lines. Dual damascene shown in FIG. 1*b* takes the process one step further in that, in addition to forming the groove (20) of a single damascene, conductive hole opening (40) is also formed in the insulating layer. The resulting composite structure of groove and hole are filled with metal simultaneously. The process is repeated as many times as required to form the multi-level interconnections between metal lines and the holes formed in between. Contact holes are formed directly over the substrate where the metal in the hole contacts the surface of the substrate, while the via holes are formed between metal layers. With copper as the conductive metal in groove (20) and/or opening (40), copper diffuses (shown with arrows (5) in the same Figures) into the surrounding dielectric material (30), causing electrical shorts with other neighboring lines (not shown), or into the underlying silicon (10), causing transistor poisoning where junction leakage occurs with reduced channel mobility in the transistor, thereby destroying the device.

In prior art, methods have been devised to prevent copper diffusion by employing a barrier between the copper interconnect and adjacent materials of a semiconductor device. FIG. 1*b* shows a conventional substrate (10), upon which a barrier (60) and a copper layer (70) are formed. Barrier (60) comprises a material which impedes the diffusion of copper from copper layer (70) into the underlying substrate (10). However, barrier (11) is not perfect as it has micro-defects such as pinholes (67) or voids in the film, and the barrier further comprises a number of grain boundaries illustrated as (61), (63), (65) and (69). Micro-defect (67) along with grain boundaries, act as weak spots in the barrier, permitting copper form copper layer (70) to diffuse (5) through to the underlying substrate (10). As shown, within micro-defect region (67) the copper of copper layer (70) comes into direct contact with substrate (10). Substrate (10) comprises silicon and silicon dioxide, through which copper rapidly diffuses from the micro-defect in the barrier, particularly at elevated temperatures. Similarly, copper rapidly diffuses along grain boundaries of the barrier when subjected to elevate temperatures.

It is common practice that to better isolate copper layer (70) from the underlying substrate (10), the thickness of barrier (60) is increased. However, increasing the thickness of the barrier also increases the resistance of the resulting copper interconnect as illustrated in FIG. 1*c* FIG. 1*c* shows a cross-section of a substrate (10) upon which an electrical interconnect comprising copper layer (90) and barrier (80) have been formed in a dielectric layer material (95). As shown, the thickness of barrier layer (80) is large in comparison to the thickness of copper layer (90). It is necessary for barrier (80) to be thick enough to adequately prevent diffusion (5) of copper from copper layer (90) into either dielectric material (95) or substrate (10).

Forming a thicker barrier reduces copper diffusion through micro-defect because the defects are more likely to be incorporated into the bulk of the barrier, thereby reducing diffusion paths through the defect. In addition, while a thicker barrier may still comprise grain boundaries leading from the upper to lower surface of the barrier, these boundaries are necessarily longer. Because the grain boundaries are long, it takes a longer time for copper to diffuse throughout the length of these longer grain boundaries. However, increasing the barrier thickness while maintaining the overall width of the interconnect increases the total resistance of the electrical interconnect due to the reduction in volume that the low resistance copper material can occupy. The barrier materials, such as nitrides, are invariably much more resistive than copper. The total width of the interconnect could be increased to counteract the increased resistance, but doing so would reduce the density of the integrated circuit. As result, the speed at which the integrated circuit operates is reduced.

Jain of U.S. Pat. No. 5,821,168 discloses a process for forming a semiconductor device in which an insulating layer is nitrided and then covered by a thin adhesion layer before depositing a composite copper layer. This process does not require a separate diffusion barrier as a portion of the insulating layer has been converted to form a diffusion barrier film, so that the over-all thickness of the barrier film is relatively small.

Sandhu, shows a copper plating process in U.S. Pat. No. 5,662,788 in which he uses a single electro-deposition step to reliably form both the metallization layer and to full the via holes. Another electro-deposition method is disclosed by Gilton, et al., in U.S. Pat. No. 5,151,168 for copper metallization of integrated circuits. First, a thin conductive barrier layer is sputtered on a wafer. The wafer is then transferred to an electrolytic bath. Metallic copper is deposited on the barrier layer to form the desired interconnect.

On the other hand, a self-contained unit for forming copper metallurgy interconnection structures on a semiconductor substrate is shown by Chen, in U.S. Pat. No. 5,723,387. The unit has an enclosed chamber with a plurality of apparatus for performing wet processes, including electroless metal plating and planarization. The unit provides a way of reducing the number of times the wafer is transferred between he wet process steps that requires environmental cleanliness and dry very clean processes steps.

Dubin, et al., disclose a method for reducing oxidation of electroplating chamber contacts and improving uniform electroplating of a substrate in U.S. Pat. No. 5,882,498. This is accomplished by preplating the contacts or fingers that manipulate substrates before loading the substrates onto the contacts.

In addition to the adhesion and diffusion problems associated with copper interconnects in general, there are problems that are encountered with electroplating itself. Specifically, copper oxide that normally forms on a copper seed layer will prevent successful electroplating thereon. It is disclosed in the instant invention an integrated method of reducing copper oxide in order to provide improved electroplating of copper interconnects.

SUMMARY OF THE INVENTION

It is therefore an object of the present invention to provide a method to improve copper process integration in the forming copper interconnects in integrated circuits.

It is another object of the present invention to provide a method of reducing copper oxide prior to electroplating copper in forming copper interconnects in integrated circuits.

It is yet another object of the present invention to provide a method for well-controlled electrochemical deposition (ECD) of copper for solid filling of a damascene trench.

These objects are accomplished by providing a semiconductor substrate having a substructure comprising devices formed in said substrate and a metal layer formed thereon; forming an inter level dielectric (ILD) layer over said substrate; patterning and etching said ILD layer to form a trench with inside walls therein; performing physical or chemical vapor deposition (PVD/CVD) of a diffusion barrier layer over said substrate including over said inside walls of said trench; forming a metal seed layer over said substrate including over said diffusion barrier layer; performing oxide reduction over said metal seed layer; forming a metal layer over said substrate including over said metal seed layer; and removing excess metal layer from said substrate.

BRIEF DESCRIPTION OF THE DRAWINGS

In the drawings that follow, similar numerals are used referring to similar parts throughout the several views.

FIG. 1*a* is a cross-sectional view of a portion of a semiconductor substrate showing the forming of a double inlaid damascene metal interconnect, according to prior art.

FIG. 1*b* is a cross-sectional view of a portion of a copper layer over a semiconductor substrate with an intervening thin diffusion barrier layer showing the diffusion of copper from the copper layer to the substrate through defects such as pinholes, cracks and grain boundaries, according to prior art.

FIG. 1*c* is a cross-sectional view of a portion of a copper interconnect in a semiconductor substrate showing a thick barrier in the interconnect to prevent copper diffusion into surrounding materials.

FIG. 2*a* is a cross-sectional view of a portion of a semiconductor substrate showing the forming of a single damascene structure, according to the present invention.

FIG. 2*b* is a cross-sectional view of a portion of a semiconductor substrate showing the forming of a diffusion barrier layer, according to the present invention.

FIG. 2*c* is a cross-sectional view of a portion of a semiconductor substrate showing the forming of a metal seed layer over the barrier layer of FIG. 2*b*, according to the present invention.

DESCRIPTION OF THE PREFERRED EMBODIMENTS

Figure 2D:
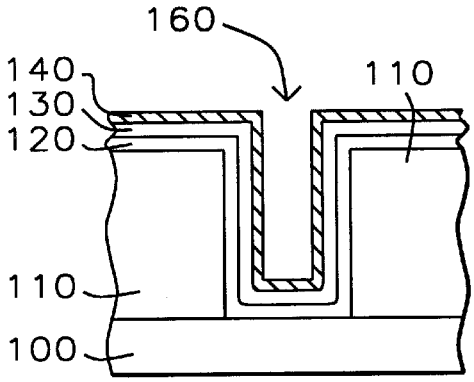
FIG. 2*d* is a cross-sectional view of a portion of a semiconductor substrate showing the forming of a metal oxide layer over the seed layer of FIG. 2*c*, according to the present invention.

Referring now the drawings, in particular to FIGS. 2*a*–2*i*, there is shown a method to improve copper process integration, in the forming of copper interconnections in integrated circuits. The improvement in the process integration is achieved by incorporating plasma cleaning of a metal seed layer prior to the deposition of the interconnect metal, either in-situ or ex-situ. Copper is the preferred metal in the embodiments of the present invention, though the method disclosed is applicable to other metals that are susceptible to oxidation.

FIG. 2*a* shows a substrate (100) upon which a single damascene trench (160) has been formed, for purposes of illustration of the invention. It will be obvious to those skilled in the art that the following steps can be applied equally well to a dual damascene structure.

Trench (160) is formed in an inter-level dielectric (ILD) layer (110) by using conventional etching techniques. Forming dielectric layers are known in the art. Blanket dielectric layers may be formed from materials including but not limited to silicon oxide materials, silicon nitride materials, and silicon oxynitrides materials formed within integrated circuits through methods including but not limited do chemical vapor deposition (CVD), plasma enhanced CVD (PECVD), or, physical vapor deposition (PVD) sputtering methods. For the preferred embodiment of the present invention, the blanket dielectric layer (110) is preferably formed of a dielectric material chosen from the group of dielectric materials consisting of silicon oxide dielectric materials, silicon nitride, silicon oxynitride, or a polyimide. Preferably, the blanket dielectric layer (160) has a thickness between about 2000 to 10000 Å. Correspondingly, trench (160) has a depth between about 2000 to 10000 Å, which is obtained by using an etch recipe comprising gases $CF_4$/$CHF_3$/Ar Next, a diffusion barrier layer (120) is formed on the substrate including the inside walls of trench (160) by using PVD or CVD methods as shown in FIG. 2*b*. It is important that this protective material be selected from a group of materials compatible with copper, that is, materials that will form a barrier to diffusion of copper into the dielectric layers surrounding the damascene structure. The barrier material is selected from a group consisting of titanium nitride, tungsten nitride, tungsten silicon nitride, tantalum silicon nitride, titanium silicon nitride or other ternary compound and the deposition is performed in an environment where the pressure is between about 10 to 50 mtorr, and temperature between about 20 to 300° C. It is preferred that diffusion barrier layer (120) has a thickness between about 50 to 300 Å.

Figure 2E:
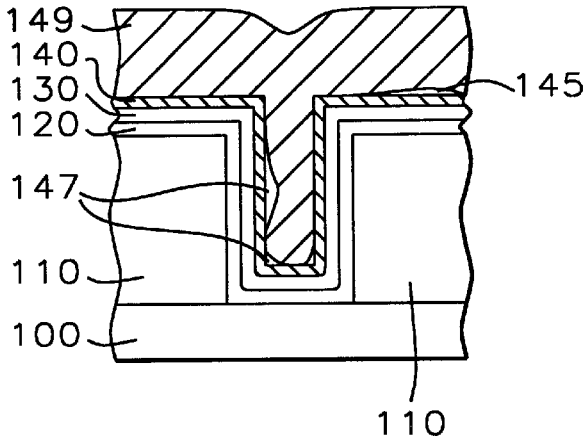
FIG. 2*e* is a cross-sectional view of a portion of a semiconductor substrate showing the forming of a poorly filled damascene metal layer because of the metal oxide of FIG. 2*d*.

It is important that the barrier lined trench (160) of FIG. 2*b* is next lined with seed layer (130) shown in FIG. 2*c* prior to the deposition of metal to form the damascene interconnect. Seed layer provides nucleation sites for the metal that is to be electro-chemically deposited (ECD) next into trench (160). This layer can be deposited using PVD/CVD techniques to a thickness between about 500 to 2000 Å. However, as practiced in the present manufacturing line, it is found that copper seed layer (130) becomes oxidized at room temperature forming cuprous oxide, $CuO_x$, readily. $CuO_x$ is shown as layer (140) in FIG. 2*d*. It is also found that layer of $CuO_x$ consumes most of the copper seed layer, thus causing wide variations in the thickness of the copper seed layer. As a result, when ECD copper (149) is formed over the irregularly formed seed layer (140), voids (147) and gaps (145) occur as shown in FIG. 2*e* with the attendant problem of ill-formed copper interconnect. That, in turn, causes poor contact between metal layers, high electrical resistance, and over-all reliability problems.

Figure 2F:
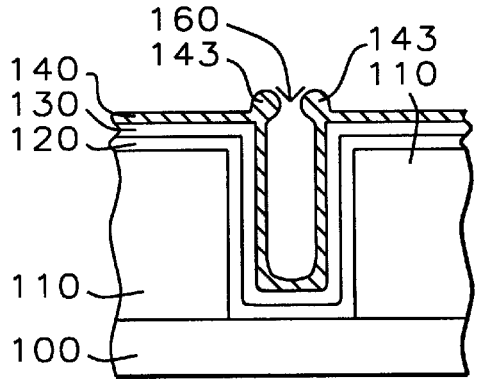
FIG. 2*f* is a cross-sectional view of a portion of a semiconductor substrate showing the forming of bulbous nodules at the edge of the damascene opening of this invention due to the forming of excessively thick metal seed layer.

It is common practice to increase the thickness of the seed layer so that there is still sufficient amount of seed layer left after the forming of the natural cuprous oxide. However, the thicker PVD/CVD deposited copper forms bulbous nodules (143) at the opening edge of the trench as shown in FIG. 2*f*. When the final layer of copper is ECD deposited in the trench, and then polished to remove the excess metal, the nodules break off resulting with a poorly formed copper interconnect.

Figure 2G:
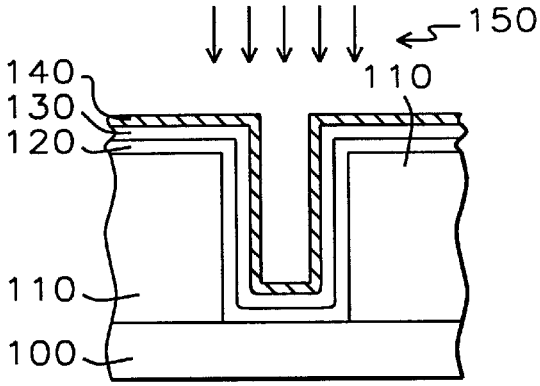
FIG. 2*g* is a cross-sectional view of a portion of a semiconductor substrate showing the plasma cleaning of the metal oxide of FIG. 2*d*, according to the present invention.
Figure 2H:
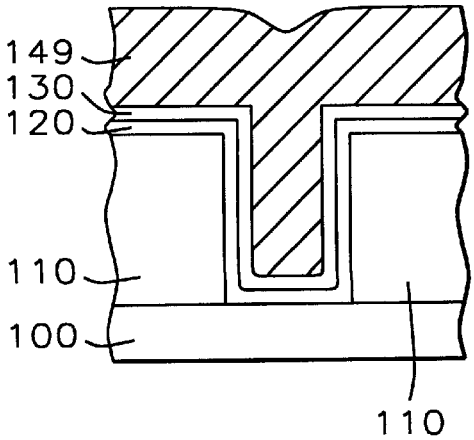
FIG. 2*h* is a cross-sectional view of a portion of a semiconductor substrate showing the electrochemical deposition of metal into the damascene trench after the plasma cleaning process of this invention.
Figure 2I:
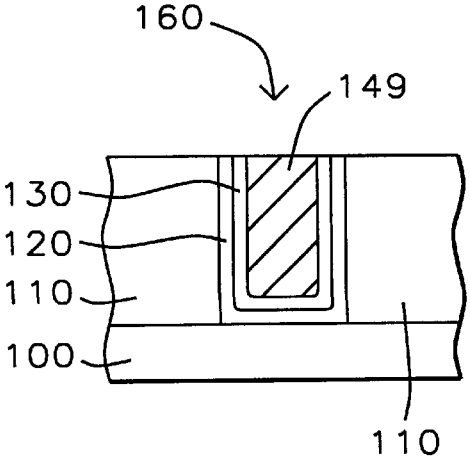
FIG. 2*i* is a cross-sectional view of a portion of a semiconductor substrate showing chemical-mechanical polishing of the excess- metal of FIG. 2*h* to form the damascene metal interconnect of this invention

In order to alleviate the problems caused by the oxidation of the seed layer, a main feature and key aspect of the present invention is to introduce plasma cleaning (150) of seed layer (1401 prior to ECD copper, as shown in FIG. 2*g*. Plasma cleaning, or copper-oxide reduction, is accomplished with $H_2$/$NH_3$ at a flow rate between about 5 to 20 sccm, or with hydrogen gas $H_2$+ a small amount of nitrogen gas $N_2$ at a flow rate between about 5 to 20 sccm. The disclosed copper-oxide process with plasma cleaning can be accomplished in-situ or ex-situ in combination with the step of electrochemical deposition of copper in trench (160). Thus, as a penultimate step, trench (160) is next over-filled with a conductive metal in general, but preferably with copper (149) of this invention, using ECD as shown in FIG. 2*h*. It will be noted that seed layer (140) becomes a part of the bulk copper layer (149). Copper is then planarized by using the well known chemical mechanical polishing technique as shown in FIG. 2*f*.

While the invention has been particularly shown and described with reference to the preferred embodiments thereof, it will be understood by those skilled in the art that various changes in form and details may be made without departing from the spirit and scope of the invention.

What is claimed is:

1. A method to improve copper process integration comprising the steps of:

providing a semiconductor substrate having a substructure comprising devices formed in said substrate and a metal layer formed thereon;

forming an inter-level dielectric layer over said substrate;

patterning and etching said inter-level dielectric layer to form a damascene trench with inside walls therein;

performing physical or chemical vapor deposition of a diffusion barrier layer over said substrate including over said inside walls of said damascene trench;

forming a metal seed layer over said substrate including over said diffusion barrier layer;

performing oxide reduction over said metal seed layer, wherein said performing said oxide reduction on said seed layer is accomplished by using $NH_3$ plasma cleaning, or $H_2$/$N_2$ thermal reduction process;

forming a metal layer over said substrate including over said metal seed layer; and removing excess metal layer from said substrate.

2. The method of claim 1, wherein said substrate is silicon.

3. The method of claim 1, wherein said inter-level dielectric layer comprises an oxide.

4. The method of claim 1, wherein said inter-level dielectric layer has a thickness between about 2000 to 10000 Å.

5. The method of claim 1, wherein said damascene trench has a depth between about 2000 to 10000 Å.

6. The method of claim 1, wherein said physical or chemical vapor deposition of diffusion barrier layer is accomplished with tantalum nitride or titanium nitride, or a ternary compound at a pressure between about 10 to 50 mtorr, temperature between about 20 to 300° C.

7. The method of claim 1, wherein said diffusion barrier layer has a thickness between about 50 to 300 Å.

8. The method of claim 1, wherein said forming a metal seed layer is accomplished by electro-chemical deposition of copper or by chemical vapor deposition of copper.

9. The method of claim 1, wherein said metal seed layer has a thickness between about 500 to 2000 Å.

10. The method of claim 1, wherein said forming a metal layer is accomplished by depositing copper.

11. The method of claim 1, wherein said removing said excess metal is accomplished by chemical-mechanical polishing.

12. A method to improve copper process integration comprising the steps of:

providing a semiconductor substrate having a substructure comprising devices formed in said substrate and a metal layer formed thereon;

forming an inter-level dielectric layer over said substrate;

forming a damascene structure in said inter-level dielectric layer;

forming a barrier layer in said damascene structure;

forming a copper seed layer over said barrier layer;

performing a copper oxide reduction over said copper seed layer, wherein said performing said copper oxide reduction on said copper seed layer is accomplished by using $NH_3$ plasma cleaning, or $H_2/N_2$ thermal reduction process;

forming a copper layer over said substrate including over said copper seed layer; and removing excess copper layer from said substrate.

13. The method of claim 12, wherein said substrate is silicon.

14. The method of claim 12, wherein said inter-level dielectric layer comprises an oxide.

15. The method of claim 12, wherein said damascene structure has a depth between about 2000 to 10000 Å.

16. The method of claim 12, wherein said barrier layer has a thickness between about 50 to 300 Å.

17. The method of claim 12, wherein said copper seed layer has a thickness between about 500 to 2000 Å.

* * * * *